US006978594B2

(12) United States Patent
Schuller et al.

(10) Patent No.: US 6,978,594 B2
(45) Date of Patent: Dec. 27, 2005

(54) PROCESS FOR THE MANUFACTURE OF A DISINTEGRATING ROLL OF AN OPEN-END SPINNING APPARATUS AS WELL AS A DISINTEGRATING ROLL MADE BY SUCH A PROCESS

(75) Inventors: Edmund Schuller, Ingolstadt (DE); Klaus Schoberth, Ingolstadt (DE); Josef Schermer, Bergheim-Unterstall (DE); Heinrich Mayer, Gaimersheim (DE); Herbert Kreis, Wettstetten (DE)

(73) Assignee: Rieter Ingolstadt, Ingolstadt (DE)

( * ) Notice: Subject to any disclaimer, the term of this patent is extended or adjusted under 35 U.S.C. 154(b) by 435 days.

(21) Appl. No.: 10/071,780

(22) Filed: Feb. 7, 2002

(65) Prior Publication Data

US 2002/0124546 A1 Sep. 12, 2002

(30) Foreign Application Priority Data

Feb. 14, 2001 (DE) ..... 101 06 673

(51) Int. Cl.[7] ..... D02G 15/84
(52) U.S. Cl. ..... 57/408; 57/112; 19/114
(58) Field of Search ..... 57/408, 409, 410, 57/112; 19/114, 98, 105, 112; 140/97, 100; 29/34 D, 34 R; 148/526, 568

(56) References Cited

U.S. PATENT DOCUMENTS

| | | | | |
|---|---|---|---|---|
| 3,833,968 A | | 9/1974 | Arai et al. | |
| 4,044,427 A | | 8/1977 | Ankrom et al. | |
| 4,211,583 A | | 7/1980 | Eadie et al. | |
| 5,096,506 A | * | 3/1992 | Hollingsworth | 148/598 |
| 5,294,270 A | * | 3/1994 | Fenical | 148/576 |
| 5,298,095 A | * | 3/1994 | Russo et al. | 148/670 |
| 5,861,067 A | * | 1/1999 | Hetzner | 148/326 |
| 6,006,511 A | | 12/1999 | Hofman et al. | |
| 6,117,249 A | * | 9/2000 | Erikson et al. | 148/226 |
| 6,289,588 B1 | | 9/2001 | Graf | |

FOREIGN PATENT DOCUMENTS

| | | |
|---|---|---|
| DE | 2433769 | 1/1976 |
| DE | 2539089 A1 | 3/1977 |
| DE | 2904841 A1 | 8/1980 |
| DE | 19951775 C1 | 11/2001 |

OTHER PUBLICATIONS

German Search Report Jun. 25, 2001.
European Patent Office Search Report Mar. 12, 2003.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

A sawtooth wire to be laid in a groove of a shredding-element-carrier of a disintegrating roll of an open-end spinning apparatus is brought into a shape, which essentially represents that shape, which the sawtooth wire is to assume on the shredding-element carrier. The sawtooth wire is preshaped on a dummy body, the circumference of which predominately conforms to that of the shredding-element carrier, or the sawtooth wire is directly preshaped on the shredding-element carrier of the disintegrating roll. The preshaped sawtooth wire is subsequently hardened, preferably inductively with the aid of a high frequency alternating current with a frequency of more than 1000 kHz. In this manner, a disintegrating roll is made, the abrasion resistant shredding element of which, after the preshaping, i.e., after is securement on the shredding-element carrier, is a hardened shredding element.

35 Claims, 1 Drawing Sheet

PROCESS FOR THE MANUFACTURE OF A DISINTEGRATING ROLL OF AN OPEN-END SPINNING APPARATUS AS WELL AS A DISINTEGRATING ROLL MADE BY SUCH A PROCESS

BACKGROUND OF THE INVENTION

The present invention concerns a process for the production of a disintegrator roll of an open-end spinning apparatus, and a disintegrator roll manufactured by such a process.

DE 25 39 089 A1 discloses a disintegrating roll which has been equipped with a toothed active shredding-element, which displayed a substantial hardness in the top zone of the teeth, but in the foot zone a lesser hardness. In this way an ascertained winding of the toothed shredding-element on the body of the disintegrating roll could be assured. To this purpose, the point of each tooth is a separate element from the foot, and must be bound thereto, for example, by welding. This process is a very labor and time intensive procedure. For economic reasons, it cannot be allowed, that such a procedure can be a part of the manufacture of disintegrating rolls for open-end spinning apparatuses, since well over a hundred such rolls are required per open-end spinning machine.

In accord with another proposal offered by DE 29 04 841 A1, each tooth of the sawtooth shredding-element exhibits a plurality of zones of different hardness, whereby the hardness of the tooth diminishes in the direction from the tooth point to the foot. The tooth foot zone, contrarily, is not hardened, in order to allow for the necessary shaping of the sawtooth wire necessitated by the winding procedure. In order to be able to deform the ends of this sawtooth wire, so that the wire can be securely laid on the roll body, it is necessary to temper these wire ends after the hardening procedure, so that the hardening of the teeth will have no effect on wire ends. The disadvantage of this step is, that it is very difficult to restrict the hardening and subsequent heat treatment to specific areas.

OBJECTS AND SUMMARY OF THE INVENTION

A principal object of the present invention is to propose a process, which enables the wear area of the teeth of a sawtooth wire to be hardened to the greatest degree, preferentially, without simultaneously hardening the foot zone of the teeth. A further object is the creation of a process, which, essentially in a simpler and more certain manner, makes possible the installation of the shredding-element, especially of a sawtooth wire. An additional object of the invention is to create a disintegrating roll, which can be manufactured with the aid of the aforesaid process. Additional objects and advantages of the invention will be set forth in part in the following description, or may be obvious from the description, or may be learned through practice of the invention.

This principal object is achieved by the sawtooth wire being converted into a shape, which essentially corresponds to the shape that the sawtooth wire is to assume on the shredding-element carrier, and the preshaped sawtooth wire being subsequently hardened. Due to the fact that the sawtooth wire is given its essentially final shape before it is mounted on the shredding-element carrier, the hardening, or the hardness provided for the shredding-element in connection with the installation of the shredding-element on a shredding-element carrier, is no longer of such importance, since no consideration need be given to a deformation during the laying of the shredding-element onto a shredding-element carrier.

Advantageously, the sawtooth wire is preshaped on a preshaping body, prior to hardening. In this manner, the sawtooth wire, when installed on the shredding-element, is subjected to no great stress as compared to the substantial deformation which otherwise would be required.

In a development of the process, provisions can be made, so that the sawtooth wire remains on a preshaping body during the hardening. Further, this preshaping body can be constructed by the shredding-element carrier itself.

Moreover, the ends of the sawtooth wire can be subjected to an grinding procedure.

Principally, the hardening of the shredding-element can be carried out in various ways. However, it has shown itself as being advantageous to harden the shredding-element by inductive heating independent of the shredding-element being sawtooth wire or a combination of needles and at least one saw tooth wire. In this way, the depth to which the hardening of the shredding-element is to be allowed is controllable.

The shredding-element exhibits a relatively small cross section. On this account it is advantageous if, in accord with a development of the invented process the formation of oxides, for instance mill scale, is prevented during the hardening process by hardening the shredding element in a protective gas.

Advantageously, the hardened shredding-element is subjected to a heat treatment for the avoidance of tensile stresses.

For the elimination of surface unevenness, such as the mill scale, it is advantageous to have the shredding-element blasted, for instance, by glass beads.

Since the material of the shredding-element becomes magnetic, while it is undergoing blasting, the shredding-element is advantageously demagnetized. Furthermore, the shredding-element can be deburred.

In spite of the hardening of the shredding-element, it is frequently desirable to further change the surface of the shredding-element which comes into contact with the to-be-opened single fibers, so that it is suited to the material to be worked. In an advantageous development of the invented process, a coating of the shredding-element can be provided.

In order to prevent the finally worked-up shredding-element from being out of round, the process can be improved in accord with the invention by a further grinding process performed in various manners. In particular, by a grinding treatment counter to the direction of the teeth of the saw tooth wire, the goal is advantageously gained wherein scale, which in the operation of the disintegrator roll can lead to non-uniform separation of fibers, is definitely removed.

The sawtooth wire, before it is brought into its shape, is a non-hardened wire. Thereby, the assurance is given that it permits itself to be brought into the desired shape. Particularly advantageous is the use of a shredding-element carrier of non-hardening material, preferably a low carbon steel, because in this way, the imparting of tension to the shredding-element carrier by the hardening of the shredding-element can be avoided.

In a further advantageous embodiment of the invention, provision is made, that the ends of the sawtooth wire, that is, both the wire start and the wire end piece, can be welded to the shredding-element carrier. Thereby, in a simple and secure way, it can prevent the sawtooth wire from loosening itself from the shredding-element carrier either during hardening or in operation. As to method of welding, essentially all known methods can be considered. In an advantageous development of the invention, the sawtooth wire is coated to better its abrasion resistance. This coating is done preferably by plasma deposition, for instance with titanium nitride.

Thereby, it is especially favorable to operate with as low temperatures as possible, so that no hardening loss occurs in the hardened shredding-element wire by the heating of the wire.

With the aid of the previously described process, in accord with the invention, a disintegrating roll can be made with desired attributes.

The roll possesses a hardened shredding-element after it is shaped, that is, after the placement of the shredding-element on the shredding-element carrier. Further, this shredding-element can be, advantageously, an induction hardened shredding-element. By means of the use of a shredding-element wire and employing a lateral groove at the foot zone of the installed shredding-element carrier, the sawtooth wire can be especially securely fastened on the shredding-element carrier, wherein the sawtooth wire is laid in the groove. By means of the shaping of the material of the shredding-element carrier, the shredding element is pressed into the groove to make a form-fit connection.

The above described process, in accord with the invention, makes possible in a simple and secure manner, an exactly controlled hardening of the shredding-element. Any danger that the shredding-element will be damaged by this operation is absent, when the shredding-element is fitted onto the shredding-element carrier. Particularly, when the shredding-element points have been hardened by induction, it is possible by means of high frequency current to limit the hardening to the points of the shredding-element, while the foot part, held by the shredding-element carrier, remains in its original condition. High frequency hardening, nevertheless, is further advantageous, in that it so hardens those areas of the teeth, which form a hardness transition in each tooth that, even in the area of the tooth-foot, a hardness is attained, which strongly reduces the attrition in this area of the shredding-element. The shredding-element, or better, its teeth, also have an advantageous uniform rate of wear respectively from the tooth point to the tooth foot.

In this way, the disintegrating rolls can be made with an expectancy of long life, a wear resistant shredding-element, and moreover, operate without risks of breakage or damage to the roll.

Embodiment examples of the invention are explained in the following with the aid of drawings.

DETAILED DESCRIPTION

Figure 1:
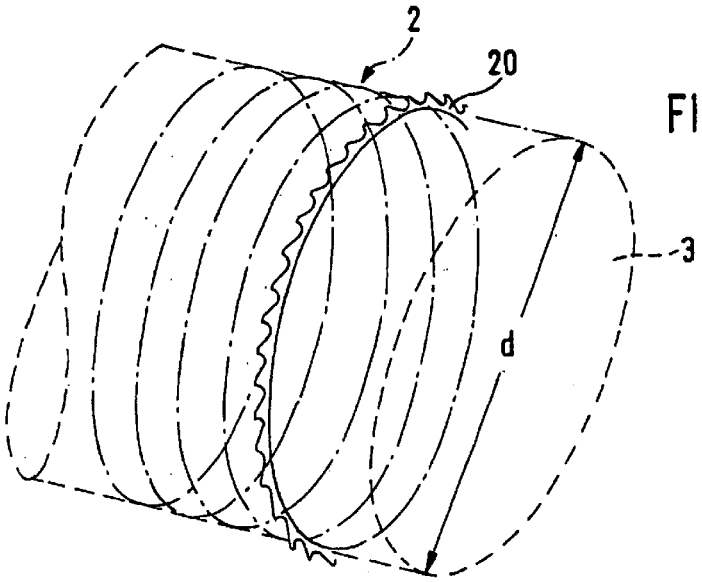
FIG. 1 shows a sawtooth wire which can be manufactured by the invented process in a perspective view.
Figure 2:
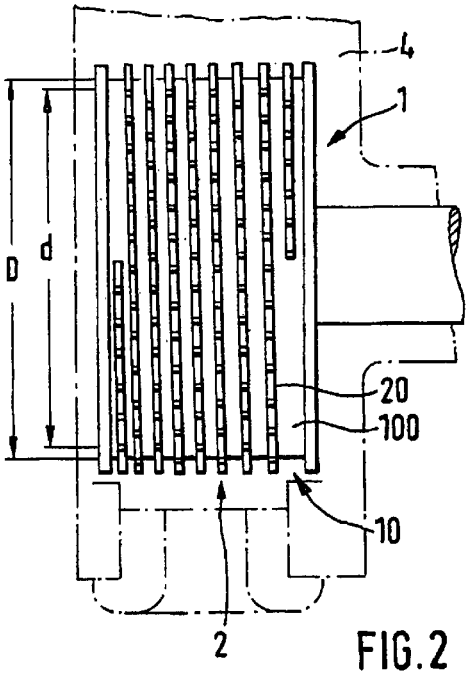
FIG. 2 shows an invented disintegrator roll in profile view.
Figure 3:
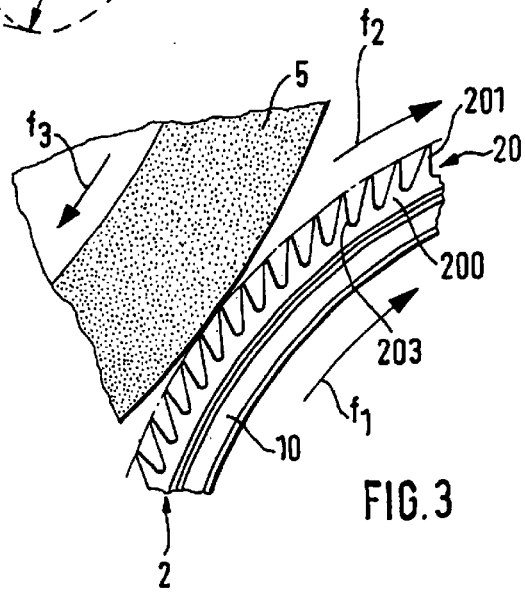
FIG. 3 shows a portion sawtooth shredding-element wrapped on a disintegrator roll as well as a grinding wheel section in profile view.

Reference will now be made in detail to the presently preferred embodiments of the invention, one or more examples of which are show in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Where open end spinning is concerned, it is necessary to reduce a sliver to individual fibers, which are then fed to an open-end spinning element (not shown) for the production of a continuous yarn. The separation of the fibers by combing from the forward progressing end of the sliver, is carried out with the aid of a disintegrator roll 1 enclosed in a housing 4. To execute its designed purpose, the disintegrator roll 4 possesses a specifically designed shredding-element 2 (FIG. 2). To serve as a shredding-element 2, a sawtooth wire 20 is employed (FIGS. 1 to 3). On the other hand, there are shredding-elements which, besides one saw tooth wire 20, exhibit still a second such sawtooth wire (not shown) and/or additionally a plurality of needles.

Because of the combing out of the forward progressing end of the sliver, the shredding-element 2 is subjected to a high degree of stress. For this reason, a hardening procedure has been provided for the shredding-element 2. Such a hardening does indeed make the shredding-element 2 hard, but it also leads to the disadvantage that the shredding-element 2 is made brittle and can be damaged upon the deformation accompanying the fitting of the shredding-element 2 onto a shredding-element carrier 10. Such damage especially occurs in the foot zone 200 (FIG. 3) where fissures can occur.

The shredding-element 10 of the disintegrator roll 1 can be formed by the base body 100 of the disintegrator roll 1. However, it is also possible to provide a ring (not shown), which, in a known manner, is held in place by clamps or the like.

In order to avoid the mentioned disadvantages and risks in accord with the process presented in the following, the flexible, unhardened sawtooth wire shredding-element, which does not yet exhibit any great hardness, is first brought into the essentially desired shape, which subsequently, in its installed condition, it will assume on the shredding-element carrier 10. In this way, the desired shape is not brought to the to-be-achieved diameter d, but the spiral shape is additionally considered, which shape the sawtooth wire 20 will assume on the shredding-element carrier on the disintegrator roll.

Principally, the shaping of the sawtooth wire 20 can be done in different ways. Advantageously, however, the sawtooth wire 20 is wound on a shaping body 3 (FIG. 1), the diameter d of which is essentially just as large as the effective diameter D of the shredding-element carrier 10 for the disintegrator roll 1. In this way, it is not required to shape the sawtooth wire in any important degree during its later installation on the shredding-element carrier 10.

The final diameter d, which the sawtooth wire 20 should obtain by the shaping, is not necessarily identical with the outside diameter of the shredding-element carrier 10. As a rule, the sawtooth wire 20 is not wound onto the outside circumference of the shredding-element carrier 10, but rather is received in spiral grooving in this outside circumference of the shredding-element carrier 10 with the result, that the diameter d represents the diameter of this grooving. This is plainly seen in FIG. 2 in which this effective diameter d of the shredding-element carrier 10 is obviously less than the outside diameter D thereof.

After the sawtooth wire 20 has taken on its desired shape, it is subjected to a hardening procedure. Principally, it is not of great importance, which special hardening procedure is applied (for instance, flame-hardening). Nevertheless, experience shows that it is particularly advantageous, if the hardening of the shredding-element 20 is done by induction. In this process, the depth of the hardening can be exactly determined by a corresponding choice of the frequency of the alternating current.

Since priority is given to having a good hardening on such surfaces as come into contact with the fibers, high frequency currents are particularly well suited for this purpose.

For that reason, the frequency of the alternating current is chosen as high as possible, so that the hardening effect is limited especially to the points 201 of the teeth. In other words, the hardening is limited to the surface of the teeth of the shredding-element. This comes about at a frequency of the alternating current of at least 1000 kHz, and especially is the case within a frequency range of 1500 and 2000 kHz. The foot area 200 of the sawtooth wire 20 remains unhardened, that is, that area where the teeth are fastened, which is seen in the direction of the shredding-element carrier 10.

The hardening of the sawtooth wire 20 can be carried out after the removal of the same from the preshaping body 3. Principally, the preshaped sawtooth wire 20 is conducted through the induced high frequency field of a coil (not shown). In this procedure, the sawtooth wire 20, in the surface area, particularly in the area of the teeth, is highly heated and, after leaving the field, is chilled.

The process, within the framework of the present invention, can be altered in various ways, especially through the substitution of individual features by equivalents or through other combinations of the features and/or equivalents. Thus, it is not required, that the hardening of the sawtooth wire 20 take place in an unsupported condition. Much more, the sawtooth wire 20, during this hardening procedure, can still remain on the preshaping carrier 3. This has the advantage, that the inductive hardening process can be limited in an especially simple and secure manner to the area of the tooth points 201 to the tooth footings 203, whereby the foot area 200 of the sawtooth wire 20 retains, essentially, its original degree of hardness.

To avoid the manipulation of the sawtooth wire 20 in an already hardened condition, provisions can be made in a development of the described process, wherein the sawtooth wire 20 is laid onto the shredding-element carrier just before the carrying out of the hardening procedure and is secured thereon. Then, the so secured sawtooth wire 20 is subjected to a hardening procedure, especially the described induction hardening.

According to an advantageous development of the previously described process, the hardening of the shredding-element 2 can be carried out under the protection of an inert gas. In this way, the surface of the sawtooth wire 20, which has been raised to a high temperature during the hardening process, is prevented from reacting with oxygen to form rust or scale, which can lead to undefined conditions and dimensioning of the teeth of the sawtooth wire 20.

Independent of what kind of hardening has been employed, there is created, in accord with the above described process, a disintegrating roll 1 having a sawtooth wire 20, which forms the shredding-element 2. This sawtooth wire is preferably only hardened inductively, after it has assumed essentially its final shape, and especially after it has been secured to the shredding-element carrier 10.

As part of the hardening procedure, there follows in the customary manner, a chilling of the sawtooth wire 20 by water, oil or the like. Thereby, inner stresses are created internally in the sawtooth wire 20 which can lead to fissuring. In order to avoid these, as soon as possible after the chilling, a heat treatment (tempering) is provided by means of which such stresses are relieved. In accord with a preferred improvement of the described process, the hardened sawtooth wire 20 during this tempering is brought principally to a temperature of about 130°. In this way, it is assured, that the steel from which the sawtooth wire 20 is made indeed loses the internal stresses, but not the hardness.

The sawtooth wire 20 which is on the shredding-element carrier 10 is, as a rule, subjected to a grinding procedure since it known from experience, that the sawtooth wire 20 installed on the shredding-element carrier 10 is generally out of round.

In accord with the embodiment depicted in FIG. 3, the disintegrator roll 1, now equipped with the sawtooth wire 20 is driven in the direction of the arrow $f_1$, that is, in the direction of the rotation (arrow $f_2$), in which the disintegrator roll 1 turns during the spinning operation. The sawtooth wire 20, which is driven by the disintegrator roll 1 during the grinding operation then moves contrary to the rotation of a grinding disk 5, which is driven in the direction indicated by the arrow $f_3$.

Not only the points 201 of the teeth, but also the ends of the sawtooth wire 20 affixed to the disintegrator roll 1 are subjected to the grinding procedure.

This operation seeks to prevent the ends of the sawtooth wire 20 fastened on the shredding-element 10, from leading in a known manner to later problems with fiber transport within the housing 4.

The hardened shredding-element 2 can still undergo a blasting operation in order to smooth its surface. This blasting can be done in customary procedures by means of blasting with sand, small glass globules or the like.

Since the shredding-element 2 is magnetized by the blasting procedure, the shredding-element 2 is advantageously demagnetized after this blasting procedure. This is done, as a rule, by the production of a corresponding magnetic counter field, whereby the shredding-element runs through the hysteresis loop with cyclic reduction of the maximal field strength.

In order to remove and round off protruding spikes and edges of the sawtooth wire 20, it is advantageous if the sawtooth wire 20 is deburred. This can be carried out in known chemical procedures in a solution known as appropriate for this purpose, or also electrolytically with the aid of an acid solution.

If desirable, for acquiring certain surface characteristics, the shredding-element can also be coated, for instance, with a galvanically applied nickel plating. In doing this, it is also possible to embed diamond kernels in the nickel layer.

It is also possible to provide on a shredding-element carrier 10 a shredding element which possesses a sawtooth wire 20 as well as needles (not shown) in combination. Further, instead of a single sawtooth wire 20, two such sawtooth wires 20 can be laid next to one another, whether the shredding-element 2 has auxiliary needles or not. Independent of the special design of a shredding-element 2 of a disintegrator roll 1, the here described process can always be advantageously applied.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for production of a disintegration roll for use in separation of fibers in an open-end apparatus, said process comprising the steps of:

converting a shredding element into a preparative configuration that corresponds to a finished configuration the shredding element assumes on the disintegration roll;

hardening at least a portion of the shredding element while it is in the preparative configuration; and using the hardened shredding element on a shredding element carrier created from a non-hardening material.

2. A process as in claim 1, wherein the shredding element is preshaped around a preshaping body to be converted into the preparative configuration, the preshaping body having a circumference essentially corresponding to the circumference of the disintegration roll.

3. A process as in claim 1, further comprising the step of grinding a working end of the shredding element which contacts the fibers.

4. A process as in claim 3, wherein the grinding occurs on teeth points of the shredding element.

5. A process as in claim 4, wherein the teeth points of the shredding element are subject to a grinding in a direction counter to the operational direction of the teeth points of the shredding element.

6. A process as in claim 5, wherein the shredding element integral to the shredding element carrier is rotated in an opposite direction of rotation of a grinding disk used to grind the shredding element.

7. A process as in claim 5, wherein the shredding element undergoes no pre-hardening procedure before it is shaped.

8. A process as in claim 1, wherein the step of hardening the shredding element is performed in a protective gas.

9. A process as in claim 1, further comprising a step of heat treating the shredding element after hardening to relieve stress in the shredding element.

10. A process as in claim 1, further comprising a step of blasting the shredding element with a particle blast after hardening.

11. A process as in claim 10, wherein the particle of the particle blast uses glass as the particle.

12. A process as in claim 10, further comprising a step of demagnetizing the shredding element.

13. A process as in claim 1, further comprising a step of deburring the shredding element.

14. A process as in claim 13, wherein the shredding element is deburred by a chemical.

15. A process as in claim 1, further comprising a step of coating the shredding element.

16. A process as in claim 15, wherein the shredding element is coated with a nickel-plating.

17. A process as in claim 15, wherein the shredding element is plasma coated.

18. A process as in claim 17, wherein the plasma coating includes titanium nitride.

19. A process as in claim 1, wherein the shredding element carrier is created from a low carbon steel.

20. A process as in claim 1, wherein the shredding element is a sawtooth wire.

21. A process, for production of a disintegration roll for use in separation of fibers in an open-end apparatus, said process comprising the steps of:

converting a shredding element into a preparative configuration around a preshaping body that corresponds to a finished configuration the shredding element assumes on the disintegration roll;

hardening at least a portion of the shredding element while it is in the preparative configuration;

using the hardened shredding element on a shredding element carrier of the disintegration roll; and wherein the shredding element remains on the preshaping body during the hardening of said at least a portion of the shredding element.

22. A process as in claim 21, wherein the preshaping body is the shredding element carrier.

23. A process, for production of a disintegration roll for use in separation of fibers in an open-end apparatus, said process comprising the steps of:

converting a shredding element into a preparative configuration by preshaping the shredding element around a preshaping body having a circumference essentially corresponding to the circumference of the disintegration roll;

hardening at least a portion of the shredding element while it is in the preparative configuration; and using the hardened shredding element on a shredding element carrier of the disintegration roll; and wherein the step of hardening the shredding element includes an induction procedure.

24. A process as in claim 23, wherein said induction procedure includes use of a high frequency current.

25. A process as in claim 24, wherein the step of hardening of the shredding element includes providing an alternating current to a working area of the shredding element at a frequency of more than 1000 kHz.

26. A process as in claim 25, wherein the alternating current is in a frequency ranging between 1500 to 2000 kHz.

27. A disintegration roll for use in separation of fibers in an open-end apparatus, said disintegration roll comprising:

a shredding element carrier created from a non-hardening material having an outer circumference; and a shredding element operably mounted to said outer circumference of said shredding element carrier, said shredding element being preshaped to conform to said outer circumference of said shredding element carrier and at least partially hardened in this preshaped form.

28. A disintegration roll as in claim 27, wherein the shredding element is coated with a nickel-plating.

29. A disintegration roll as in claim 27, wherein the shredding element undergoes no pre-hardening procedure before it is shaped.

30. A disintegration roll as in claim 27, wherein said shredding element is preshaped on the shredding element carrier and hardened on said shredding element carrier.

31. A disintegration roll as in claim 27, wherein the shredding element is plasma coated.

32. A disintegration roll as in claim 31, wherein the plasma coating includes titanium nitride.

33. A disintegration roll as in claim 27, wherein the shredding element is a sawtooth wire.

34. A process as in claim 27, wherein the shredding element is deburred by a chemical.

35. A disintegration roll, for use in separation of fibers in an open-end apparatus, said disintegration roll comprising:

a shredding element carrier having an outer circumference;

a shredding element operably mounted to said outer circumference of said shredding element carrier, said shredding element being preshaped to conform to said outer circumference of said shredding element carrier and at least partially hardened in this preshaped form; and wherein said shredding element is hardened by an induction procedure.

* * * * *